US006810536B2

(12) United States Patent
Yamamoto et al.

(10) Patent No.: US 6,810,536 B2
(45) Date of Patent: Nov. 2, 2004

(54) SWIMMING GOGGLES

(75) Inventors: Tamenobu Yamamoto, Nishinomiya (JP); Yoshihisa Ishiba, Daito (JP); Kazuko Mabuchi, Higashiosaka (JP)

(73) Assignee: Yamamoto Kogaku Co., Ltd., Osaka (JP)

( * ) Notice: Subject to any disclaimer, the term of this patent is extended or adjusted under 35 U.S.C. 154(b) by 77 days.

(21) Appl. No.: 10/158,347

(22) Filed: May 29, 2002

(65) Prior Publication Data

US 2002/0178491 A1 Dec. 5, 2002

(30) Foreign Application Priority Data

May 30, 2001 (JP) ..... 2001-162747

(51) Int. Cl.[7] ..... A61F 9/02
(52) U.S. Cl. ..... 2/428
(58) Field of Search ..... 2/428, 429, 430, 2/431, 434, 435, 439, 440, 442

(56) References Cited

U.S. PATENT DOCUMENTS 4,414,693 A * 11/1983 Brody ..... 2/435
5,331,691 A * 7/1994 Runckel ..... 2/428
5,603,125 A * 2/1997 Chou ..... 2/428

* cited by examiner

*Primary Examiner*—Peter Nerbun
(74) *Attorney, Agent, or Firm*—Koda & Androlia

(57) ABSTRACT

Swimming goggles include goggle frames and associated goggle lenses. Each goggle lens has an outer composing layer and an inner composing layer which is unified with the associated goggle frame. The inner composing layer is welded together to an inside face of the outer composing layer. The goggle frame is welded together to a peripheral side face of the outer composing layer. In this way, the goggle frame and the associated goggle lens are unified together. The swimming goggles are free from water penetration between the goggle frames and the goggle lenses, and allow a high productivity and a low incidence of defected products.

37 Claims, 10 Drawing Sheets

SWIMMING GOGGLES

BACKGROUND OF THE INVENTION

1. Field of the Invention

The present invention relates to a pair of goggles for use in swimming or diving (hereinafter referred to as swimming goggles).

2. Prior Art

A pair of conventional swimming goggles of this type includes a goggle body and a headband connected to the goggle body. The goggle body has a goggle frame or frames with a face pad or pads and goggle lenses fitted into the goggle frame(s).

There are some conventional ways to fit the goggle lens into the goggle frame. One example is to put a goggle lens with a desired shape in a mold, to apply molten resin for a goggle frame around the goggle lens and to solidify the resin to fix the goggle lens in the goggle frame. Another example is to prepare a goggle frame and a goggle lens cut into a little larger size than the size of the goggle frame and then to forcibly put the lens into the goggle frame.

It is essential for swimming goggles, due to the purpose thereof, to have air tightness along the peripheral edge of the lens, and the goggle lens must be homogeneous and should not have any degree or prism.

However, in the swimming goggles in which a goggle lens is held by a goggle frame by the method that molten resin for the goggle frame is applied around the peripheral edge of the goggle lens and solidified, the method often causes a gap between the goggle lens and the goggle frame due to shrinkage or deformation after solidification of the resin material to be the goggle frame, and thereby resulting in low yields. On the other hand, the swimming goggles in which the goggle lens is fitted into the goggle frame by force are likely to have a gap due to a dimensional error of the goggle lens and the goggle frame, and this requires an additional process of sealing the gap.

Furthermore, the above processes of fitting the goggle lens in the goggle frame cause bending stress on the forgoing conventional swimming goggles, which might give degree or prism on the lens.

Consequently, the manufacturing of the above conventional swimming goggles has led to extremely poor productivity and high incidence of defective products.

It is, therefore, an object of the present invention to overcome the problems present in the above mentioned swimming goggles. More specifically it is an object of the present invention to provide swimming goggles which may be free from water-penetration between the goggle frames and the goggle lenses, and may be manufactured with a high productivity and a low incidence of defective units.

THE SUMMARY OF THE INVENTION

Swimming goggles according to the present invention has goggle frames and associated goggle lenses. Each of the goggle lenses includes an outer composing layer and an inner composing layer which is unified with the associated goggle frame. The inner composing layer is welded together to an inside face of the outer composing layer. The goggle frame is welded together to a peripheral side face of the outer composing layer. Thereby the goggle frame and the associated goggle lens are unified together.

In the swimming goggles according to the present invention, each of goggle lenses may have an inner composing layer and an outer composing layer which is unified with the associated goggle frame. Here, the outer composing layer is welded together to an outside face of the inner composing layer and the goggle frame is welded together to a peripheral side face of the inner composing layer. And thereby the goggle frame and the goggle lens are unified together.

Further, in the swimming goggles according to the present invention, each of the goggle lenses may include an outer composing layer, an inner composing layer and a middle composing layer which is unified with the associated goggle frame. The middle composing layer is welded together to an inside face of the outer composing layer and an outside face of the inner composing layer, and the goggle frame is welded together to a peripheral side face of the outer composing layer and that of the inner composing layer. As a result, the goggle frame and the goggle lens are unified together.

Furthermore, swimming goggles according to the present invention may have goggle frames and associated goggle lenses. Each of the goggle lenses includes an outer and an inner composing layer. The goggle lens and the goggle frame associating with each other are produced in a way that the outer composing layer is put in an injection mold, and then molten resin is filled into the injection mold to be deposited onto (or welded together to) an inside face of the outer composing layer to produce the goggle lens with the inner composing layer. And further molten resin is deposited onto a peripheral side face of the outer composing layer to form the goggle frame unified with the goggle lens.

In the swimming goggles according to the present invention, the goggle lens and the goggle frame associating with each other may be produced in a way that the inner composing layer is put in an injection mold, and then molten resin is filled into the injection mold to be deposited on an outside face of the inner composing layer to produce the goggle lens with the outer composing layer. And further molten resin is deposited onto a peripheral side face of the inner composing layer to form the goggle frame so that a unified body with the goggle frame and the goggle lens is obtained.

In the swimming goggles according to the present invention, the goggle lens and the goggle frame associating with each other may be produced in a way that the outer and the inner composing layers are put in an injection mold, and then molten resin is filled into the injection mold to be deposited on and welded together to an inside face of the outer composing layer and an outside face of the inner composing layer to produce the goggle lens with the middle composing layer. And further molten resin is deposited onto a peripheral side face of the outer composing layer and a peripheral side face of the inner composing layer to form the goggle frame, and to produce a unified body of the goggle frame and the goggle lens.

It may be preferable in the swimming goggles according to the present invention to use polycarbonate resin for the goggle frame and lens.

In the swimming goggles according to the present invention, the outer composing layer and the inner composing layer may respectively have radiuses of curvature calculated in advance.

In the swimming goggles according to the present invention, a functional film or sheet may be joined with the outer composing layer or the inner composing layer.

In the swimming goggles according to the present invention, functional dye may be contained in the outer, inner or middle composing layer.

The above and other objects, features and advantages of the present invention will become apparent from the following description read in conjunction with the accompanying drawings, in which like reference numbers designate the same elements.

DETAILED DESCRIPTION OF THE INVENTION

Figure 1:
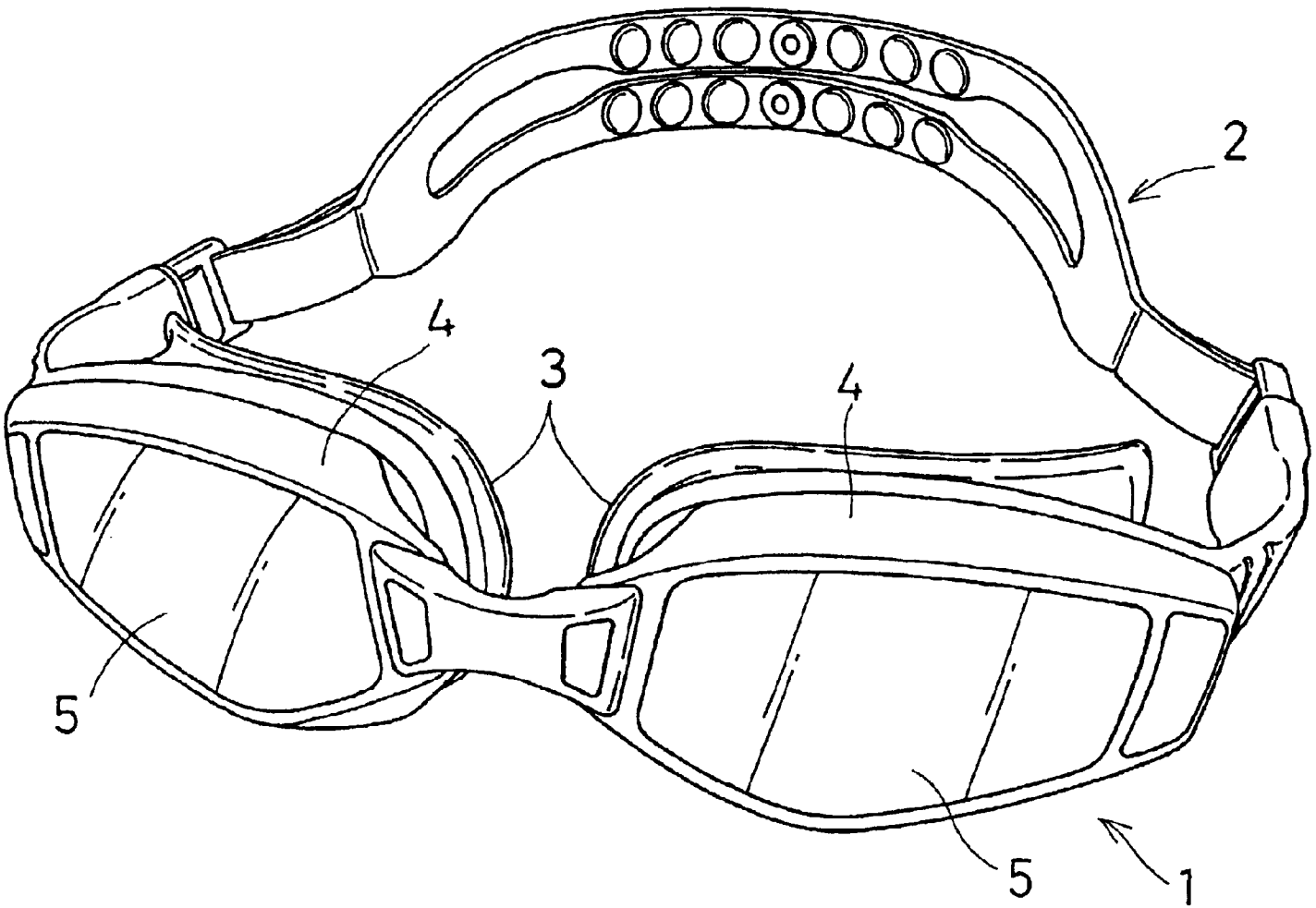
FIG. 1 is a perspective view showing the entire swimming goggles according to an embodiment of the present invention.

As shown in FIG. 1, a pair of swimming goggles of the present invention includes a goggle body 1 and a headband 2 connected to the goggle body 1. The goggle body 1 includes goggle frames 4 having face pads 3 goggle lenses 5 fixed to the associated goggle frames 4.

Figure 2:
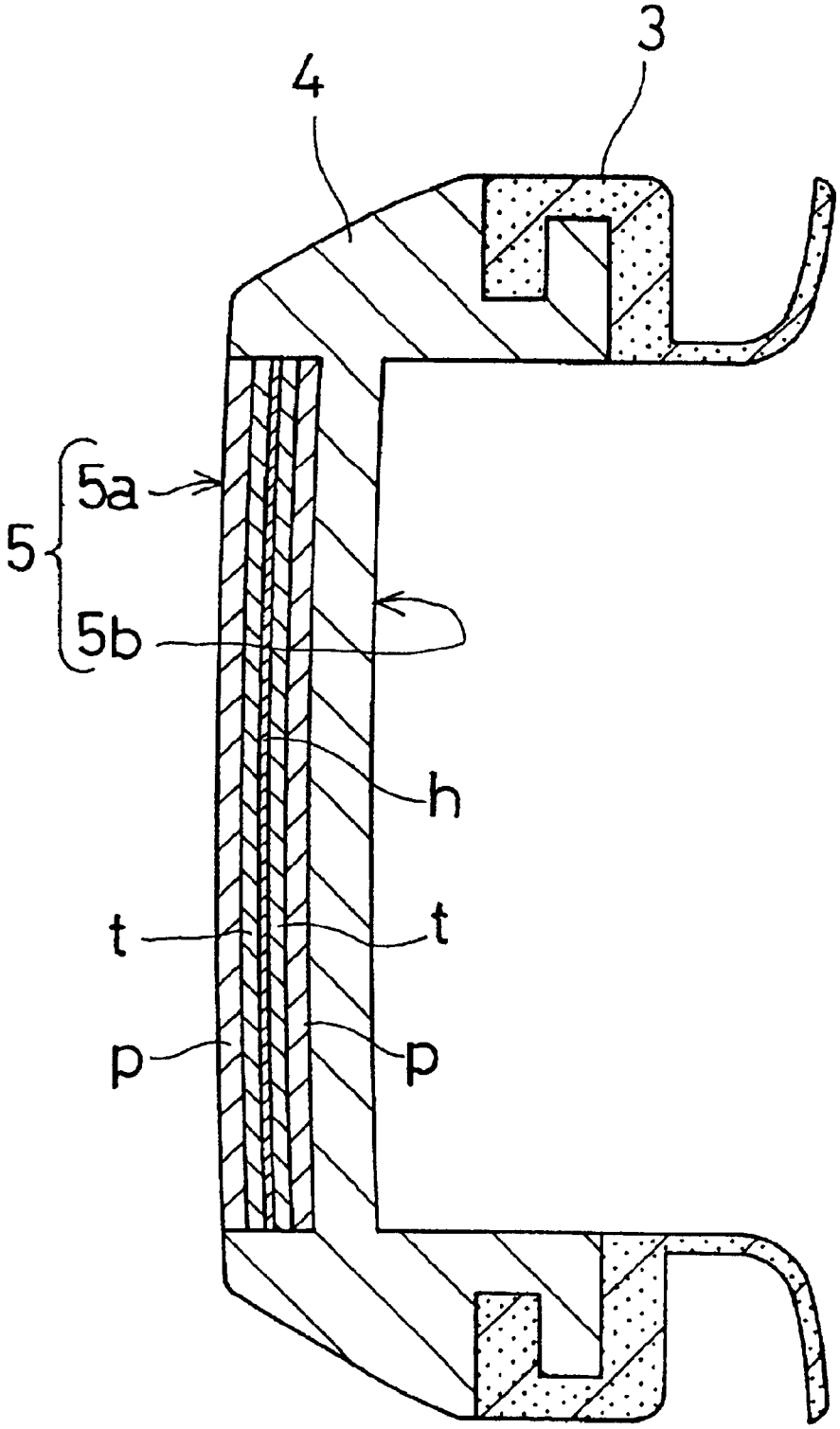
FIG. 2 is a sectional view showing main portions of an embodiment of swimming goggles of the present invention.
Figure 3:
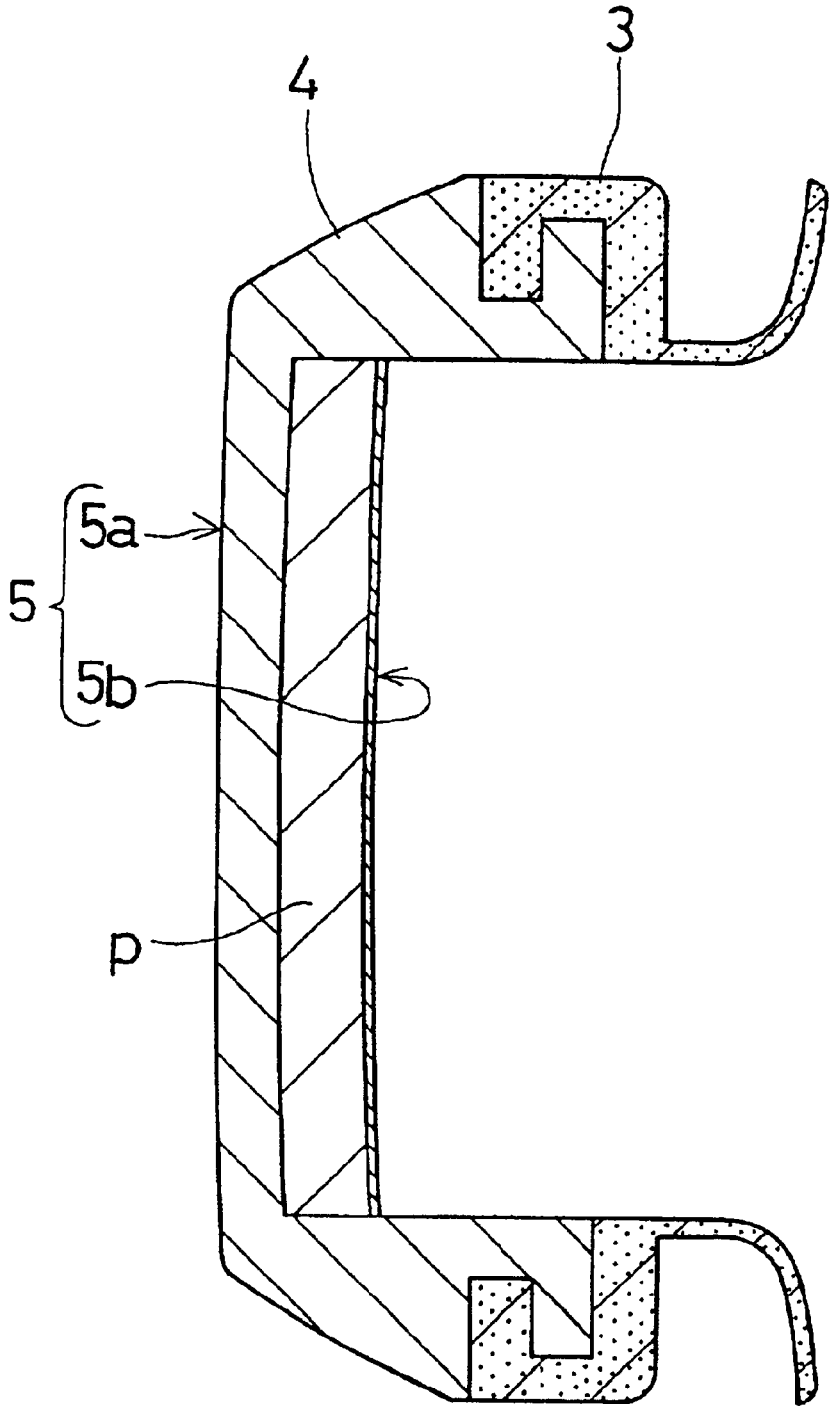
FIG. 3 is a sectional view showing main portions of another embodiment of swimming goggles of the present invention.
Figure 7:
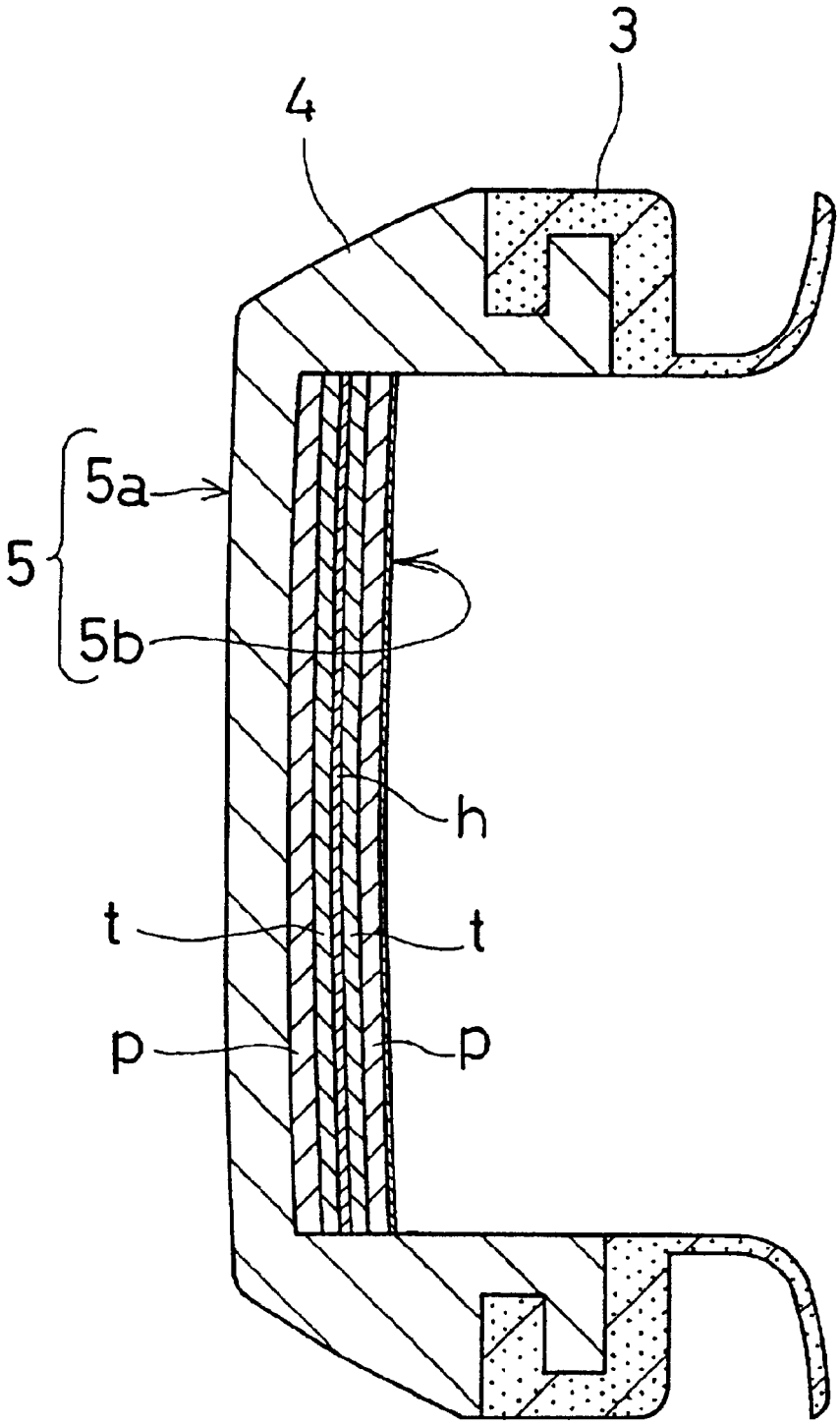
FIG. 7 is a sectional view showing main portions of another embodiment of swimming goggles of the present invention.
Figure 8:
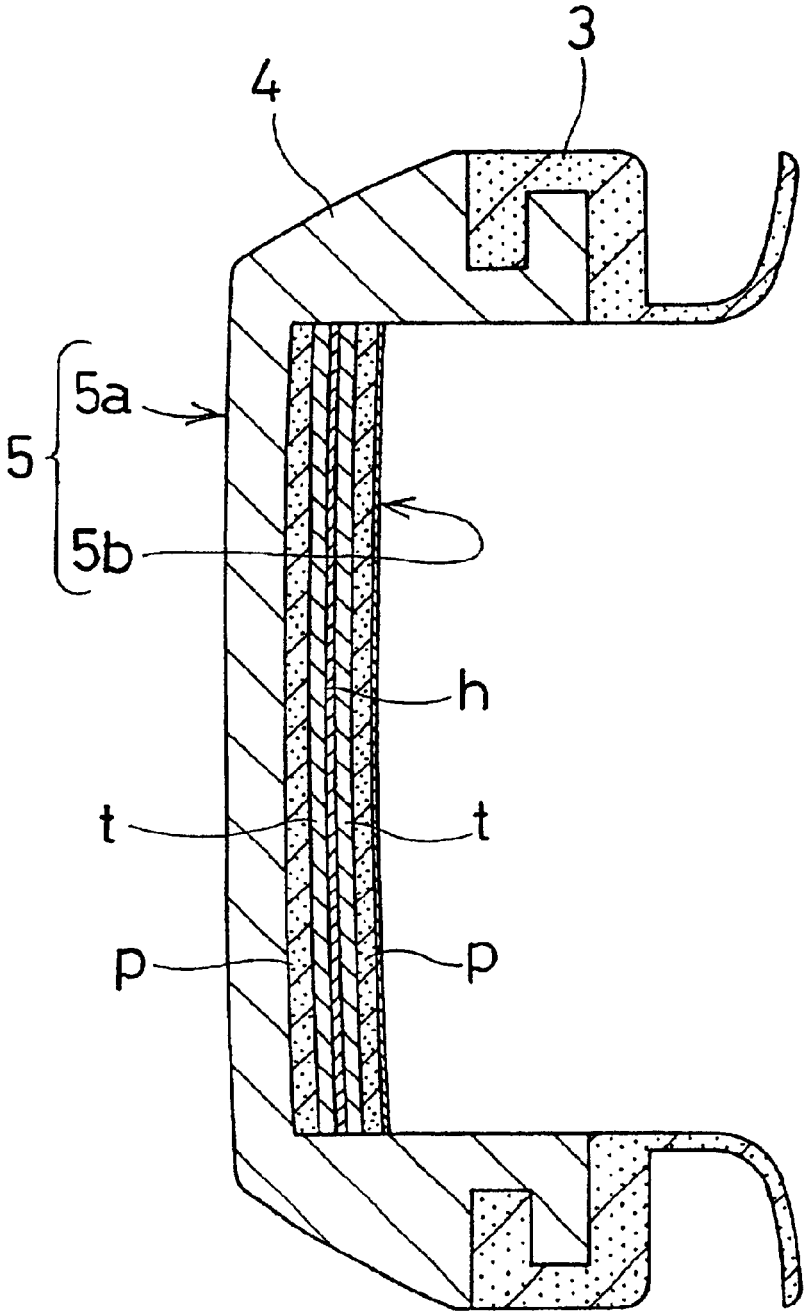
FIG. 8 is a sectional view showing main portions of another embodiment of swimming goggles of the present invention.
Figure 9:
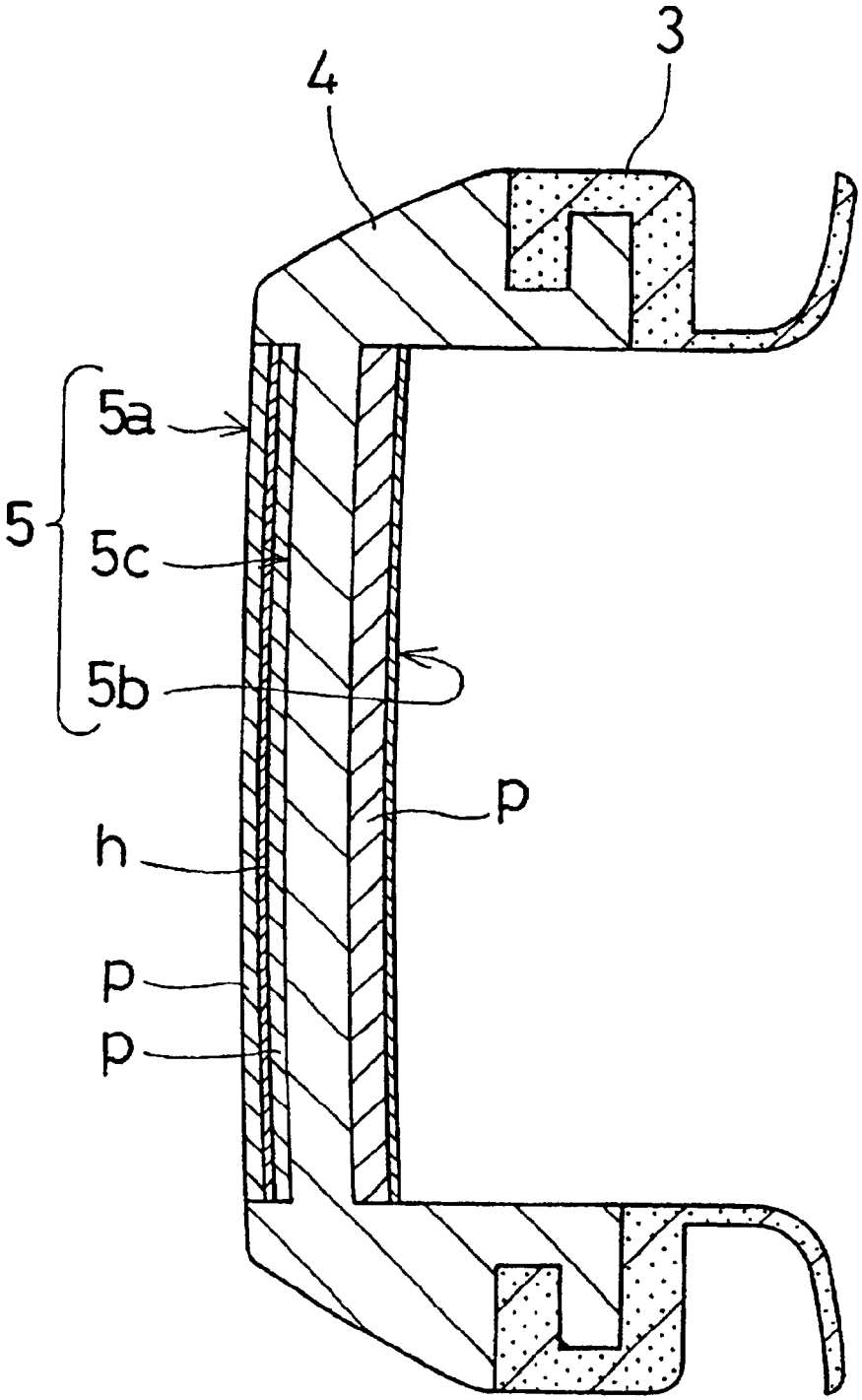
FIG. 9 is a sectional view showing main portions of another embodiment of swimming goggles of the present invention.
Figure 10:
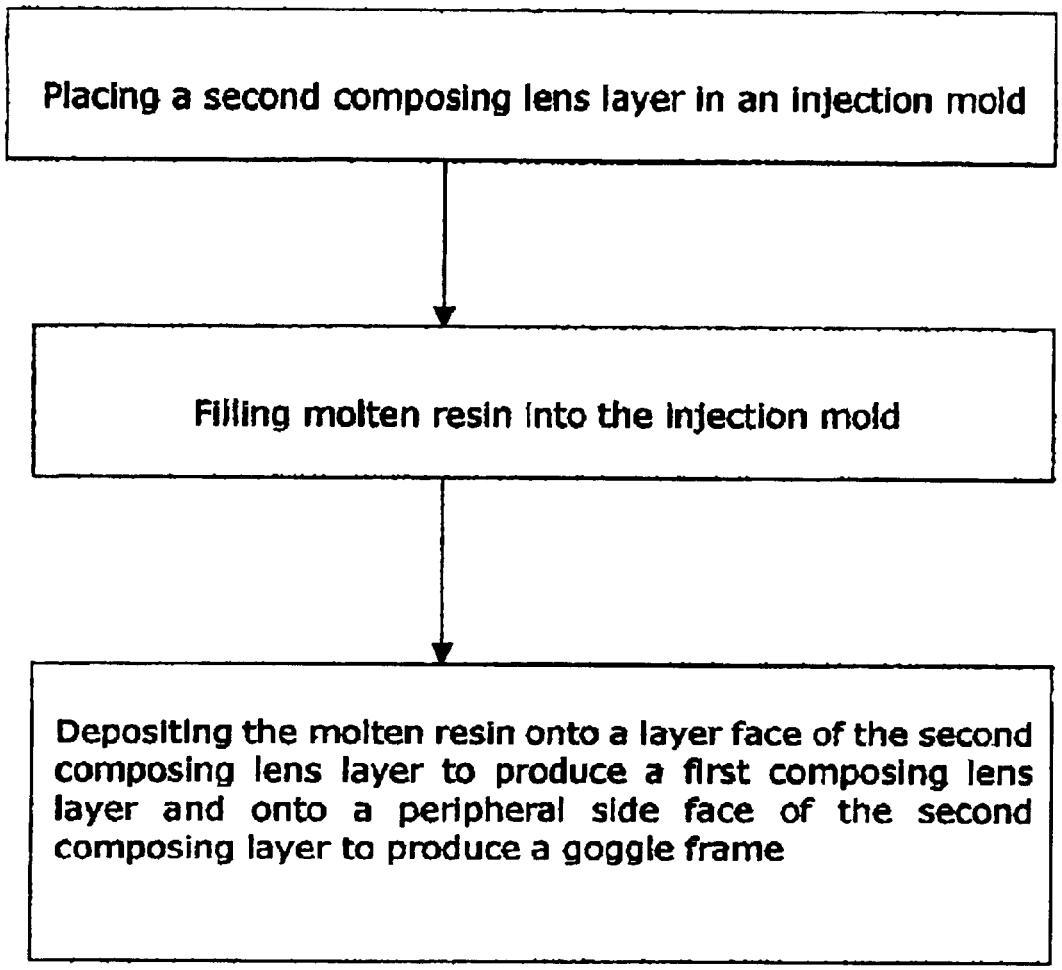
FIG. 10 is a block diagram of the method of making the swimming goggles of the present invention.

The goggle lens 5 may be fixed to the goggle frame 4 in any one of the following three structures. A first structure is shown in FIGS. 2, 4, 5 and 6. A goggle lens 5 has an outer composing layer 5*a* and an inner composing layer 5*b*. The inner composing layer 5*b* is unified with the goggle frame 4 and welded together to an inside layer face of the outer composing layer 5*a*. The peripheral side face of the outer composing layer 5*a* is welded together to the goggle frame 4. As a result the goggle frame 4 and the goggle lens 5 are integrated. A second structure is shown in FIGS. 3, 7 and 8. The outer composing layer 5*a* of the goggle lens which is unified with the goggle frame 4 is welded together to an outside face of the inner composing layer 5*b* of the goggle lens 5. The peripheral side face of the inner composing layer 5*b* of the goggle lens is welded together to the goggle frame 4 to provide an integrated structure of the goggle frame 4 and the goggle lens 5. A third structure is shown in FIG. 9. In this structure, the goggle lens 5 has further a middle composing layer 5*c* which is unified with the goggle frame 4. The middle composing layer 5*c* of the goggle lens 5 is welded together to the inside face of the outer composing layer 5*a* of the goggle lens 5, and the goggle frame 4 is welded together to the peripheral side face of the outer composing layer 5*a* of the goggle lens 5. Furthermore, the outside face of the inner composing layer 5*b* is welded together to the middle composing layer 5*b*, and the goggle frame 4 is welded together to a peripheral side face of the inner composing layer 5*b*, so that an integrated structure of the goggle frame 4 and the goggle lens 5 is obtained.

In case for fixing the goggle lens 5 with the goggle frame 4 as shown in FIGS. 2, 4, 5, 6 and 10 the outer composing layer 5*a* for the goggle lens 5 is put in an injection mold (not shown), and molten resin is filled in the injection mold to be deposited onto or welded together to the inner surface of the outer composing layer 5*a* to form the goggle lens 5 with the inner composing layer 5*b*. Furthermore, molten resin is further deposited onto the peripheral side face of the outer composing layer 5*a* so as to form the goggle frame 4. And thereby the goggle frame 4 and the goggle lens 5 are unified together. In this specification the words "be deposited onto" and "be welded together to" are used exchangeably.

And in case for fixing the goggle lens 5 with the goggle frame 4 as shown in FIGS. 3, 7 and 8, the inner composing layer 5*b* of the goggle lens 5 is put in an injection mold (not shown), and molten resin is filled in the injection mold to be deposited onto the outside face of the inner composing layer 5*b* so as to provide the goggle lens 5 with the outer composing layer 5*a*. And molten resin is further deposited onto the peripheral side face of the inner composing layer 5*b* to form the goggle frame 4. Accordingly, the goggle frame 4 and the goggle lens 5 are unified together.

Furthermore, in case for fixing the goggle lens 5 with the goggle frame 4 as shown in FIG. 9, the outer composing layer 5*a* and the inner composing layer 5*b* of the goggle lens 5 are put in an injection mold, and molten resin is filled in the injection mold to be welded together to the inside face of the outer composing layer 5*a* and the outside face of the inner composing layer 5*b* so as to provide the goggle lens with the middle composing layer 5*c*. And molten resin is further deposited onto the peripheral side face of the outer composing layer 5*a* and the peripheral side face of the inner composing layer 5*b* to form the goggle frame 4. And thereby the goggle frame 4 and the goggle lens are unified together.

Materials for the goggle frame 4, the outer composing layer 5*a*, the inner composing layer 5*b* and the middle composing layer for the swimming goggles according to the present invention may include, for example, polycarbonate resin, poly methyl methacrylate resin, polystyrene resin, acrylonitrile butadiene styrene copolymer (ABS resin), acrylonitrile styrene copolymer (AS resin), vinyl chloride resin, polyethylene terephthalate resin, polyamide resin, cellulose propionate resin, or cellulose acetate resin. Polycarbonate resin is preferable in terms of toughness and transparency. More specifically, bisphenol A polycarbonate is preferable, but not limited thereto, other examples may include single polycarbonate such as 1,1-bis(4-hydroxy phenyl)-1-phenyl ethane, bis(4-hydroxy phenyl) diphenyl methane, 2,2-bis(4-hydroxy-3-methyl phenyl) propane, copolymer polycarbonate of the above, and copolymer polycarbonate with bisphenol A.

The outer composing layer 5*a*. and the inner composing layer 5*b* of the goggle lens 5 are respectively provided with radiuses of curvature calculated in advance in order not to have any degree of angle or in order to have a desired degree. More specifically, by a bending process, the outer composing layer 5*a* of the goggle lens 5 is provided on the outside face with a radius of curvature of 100 mm or more.

The inner composing layer 5*b* of the goggle lens 5 unified with the goggle frame 4 is welded together to the inside surface of the enter composing layer 5*a* of the goggle lens 5 so as to be provided, on the inside surface, with a radius of curvature calculated to have no degree of angle or a desired degree on the goggle lens 5. And the peripheral side face of the outer composing layer 5*a* is welded together to the goggle frame 4. Alternatively, by a bending process, the inner composing layer 5*b* of the goggle lens is provided on the inside face with a radius of curvature of 100 mm or more. The outer composing layer 5*a* of the goggle lass 5 unified with the goggle frame 4 is welded together to the outside face of the inner composing layer 5*a* so as to be provided on the outside face, with a radius of curvature calculated either not to have any degree or to have a desired degree on the goggle lens 5. And then the peripheral side of the inner composing layer 5*b* is welded together to the goggle frame 4. The outer composing layer 5*a* or the inner composing layer 5*b* of the goggle lens 5 has a thickness of about 0.2 to 1.5 mm, and the goggle lens 5 as a whole has a largest thickness of about 1.0 to 4.5 mm. Also, the outer composing layer 5*a* or the inner composing layer 5*b* of the goggle lens 5 may preferably be processed with heat, but not limitative thereto, and cold processing may be also used if the conditions allow plastic deformation.

Furthermore, the outer composing layer 5*a* or the inner composing layer 5*b* of the goggle lens 5 may include a functional film or a functional sheet thereon. The functional film or sheet may be, for example, a polarized film or sheet, a photo chromic film or sheet, a hard coat film or sheet, or an anti-fog film or sheet. The above functional films or sheets may be used in a combination such as that a hard coat film or sheet is attached to the outer composing layer 5*a* and a polarized film or sheet is attached to the inner composing layer 5*b*.

The outer composing layer 5*a*, the inner composing layer 5*b*, and/or the middle composing layer 5*c* of the goggle lens 5 may include a material containing a functional dye. The functional dye may be, for example, a photo chromic dye, or a dye with function of absorbing UV rays, infrared rays, or visible rays. The functional dye may fully function when it is contained 0.01 to 0.1% by weight in molten resin to be filled in the injection mold.

The swimming goggles of the present invention will be detailed in the following embodiments.

[Embodiment 1]

A laminate-processed five-layer polarized member, which is composed of an about 40 μm-thick polarized sheet h, about 80 μm-thick triacetyl cellulose sheets t applied on both sides of the polarized sheet h, and about 100 μm-thick bisphenol A polycarbonate sheets p applied on the sheets t, is subjected to a spherical heat bending process so as to give the outer surface a radius of curvature of 130 mm, and then is processed in accordance with the external dimensions of the goggle lens 5, thereby obtaining the outer composing layer 5*a*. This layer 5*a* is put into an injection mold.

The injection mold is provided with a suction mechanism which allows the outside face of the outer composing layer 5*a* to be joined with the fixed side of the mold when the mold is closed. When molten resin is filled into the closed injection mold, the molten resin is deposited onto the inner surface of the outer composing layer 5*a* and adheres thereto so as to produce the goggle lens 5 having the inner composing layer 5*b*, and the molten resin is also deposited onto the peripheral side face of the outer composing layer 5*a* to form the goggle frame 4, thereby the goggle frame 4 and the goggle lens 5 are unified together as shown in FIG. 2.

When the goggle lens 5 was adjusted to have a radius of curvature of 128 mm on the inside face with respect to the radius of curvature of 130 mm on the outside face, the center had a thickness of 2.5 mm and the optical center had −0.04 diopter when measured with a lens meter. This satisfies JIS (Japanese Industrial Standards). In an actual use in swimming, the swimming goggles in which the goggle frames 4 and the goggle lenses 5 are unified caused no water penetration therebetween, and no large decrease in the degree of polarization. Furthermore, the degree of angle underwater was not different from that of conventional ones, and no prism was introduced while they were in use. In addition, after a certain time period of use, there found nothing defective about the goggle lenses 5.

[Embodiment 2]

An anti-fog member, which is made of a 1.2 mm-thick bisphenol A polycarbonate sheet p, the inside face of which had a defogging process, is subjected to a spherical heat bending process to be provided on the inside face with a radius curvature of 525 mm, and then is processed in accordance with the external dimensions of the goggle lens 5 to form the inner composing layer 5*b*. Then, this inner composing layer 5*b* is put into an injection mold.

The injection mold is provided with a suction mechanism which allows the inside face of the inner composing layer 5*b* so be joined on a movable side of the mold when the mold is closed. When molten resin is filled into the closed injection mold, the molten resin is deposited onto the outer surface of the inner composing layer 5*b* and adheres thereon to produce the goggle lens 5 with the outer composing layer 5*a*, and the molten resin is further deposited onto the peripheral side face of the inner composing layer 5*b* to form the goggle frame 4. Then the goggle frame 4 and the goggle lens 5 are unified as shown in FIG. 3.

When the goggle lens 5 is adjusted to have a radius of curvature of 532 mm on the outside face with respect to the radius of curvature of 525 mm on the inside face, the center became 2.5 mm thick, and the optical center had −0.01 diopter when measured with a lens meter. This meets the Japanese Industrial Standards (JIS). The swimming goggles of this embodiment in which the goggle frame 4 and the goggle lenses 5 are unified together caused no water penetration between the goggle frames 4 and the goggle lenses 5 in an actual use in swimming, and the inside face of the lens exhibited homogeneous defogging performance and fogging thereon was extremely suppressed. Furthermore, the degree of angle under water was not changed from that of conventional ones, and no prism was introduced while they were in use. In addition, after a predetermined time period of use, there existed nothing wrong about the goggle lenses 5.

[Embodiment 3]

A laminate-processed five-layer polarized member, which is composed of an about 40 μm-thick polarized sheet h, about 80 μm-thick triacetyl cellulose sheets t applied on both sides of the polarized sheeth, and about 100 μm-thick bisphenol A polycarbonate sheets p applied on the sheets t, is subjected to a spherical heat bending process so as to be provided on the outside face with a radius of curvature of 130 mm and is processed in accordance with the external dimensions of the goggle lens 5 to form the outer composing layer 5*a*. This layer 5*a* is put into an injection mold. The bisphenol A polycarbonate sheets p contain photo chromic dye of 0.1% by weight.

Figure 4:
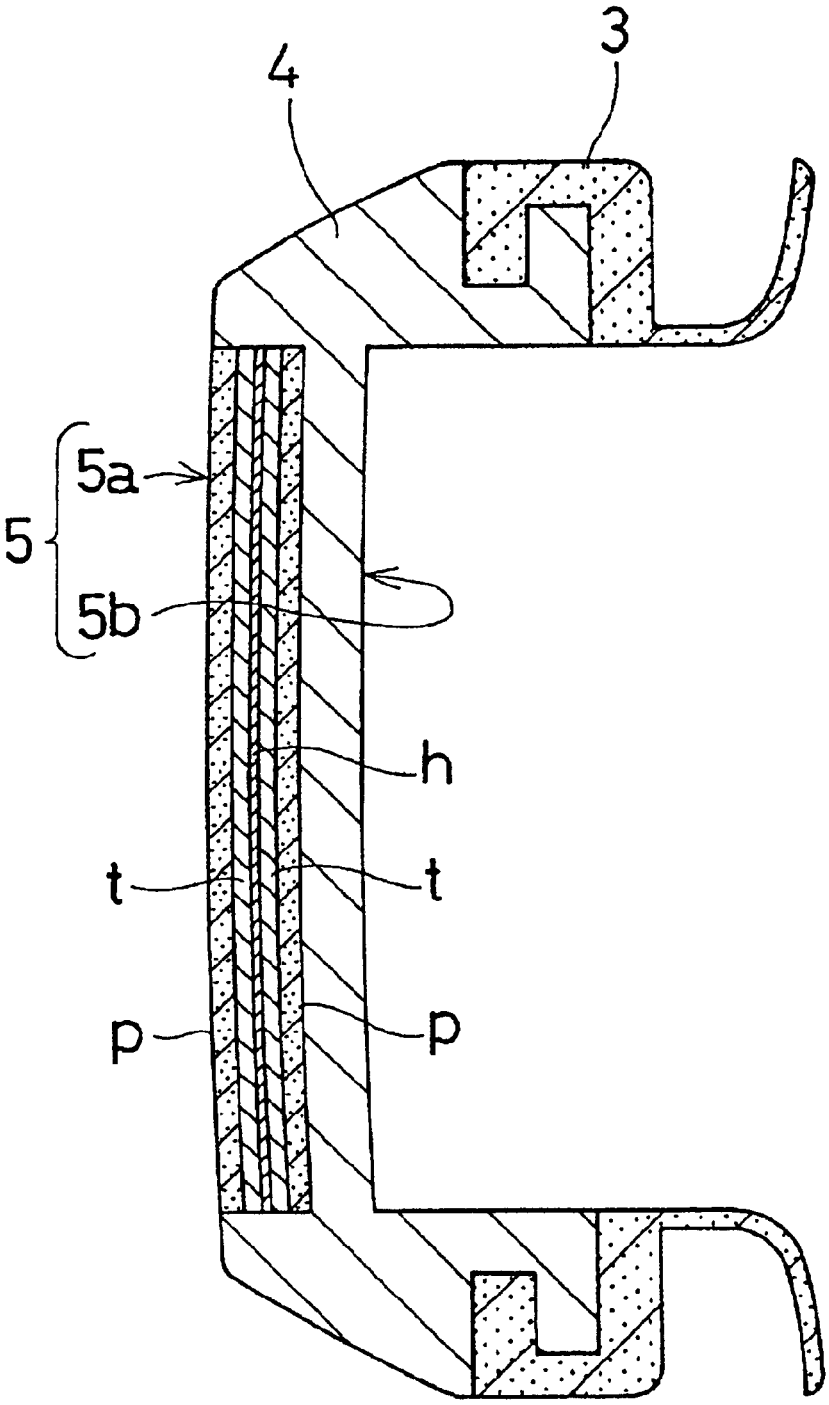
FIG. 4 is a sectional view showing main portions of another embodiment of swimming goggles of the present invention.

Next, using the same injection mold and taking the same processes as in Embodiment 1, there results in a unified body of the goggle frame 4 and the goggle lens 5, as shown in FIG. 4.

The swimming goggles of this embodiment in which the goggle frames 4 and the goggle lenses 5 are unified caused no water penetration between the goggle frames 4 and the goggle lenses 5 in an actual use in swimming, and no large decrease in the degree of polarization, and exhibited a sufficient photo chromic function. Furthermore, the degree of angle under water was not changed from that of conventional ones, and no prism was introduced while they were in use. In addition, after a certain time period of use, there found nothing defective about the goggle lenses 5.

[Embodiment 4]

A laminate-processed six-layer polarized member, which is composed of an about 40 μm-thick polarized sheet h, about 80 μm-thick triacetyl cellulose sheets t applied on both sides of the polarized sheet h, about 100 μm-thick bisphenol A polycarbonate sheets p applied on the sheets t, and an about 10 μm-thick hard coat c applied on the outside face, is subjected to a spherical heat bending process so as to be provided on the outside face with a radius of curvature of 130 mm, and then is processed in accordance with the external dimensions of the goggle lens 5 to form the outer composing layer 5*a*. This outer composing layer 5*a* is put into an injection mold.

Figure 5:
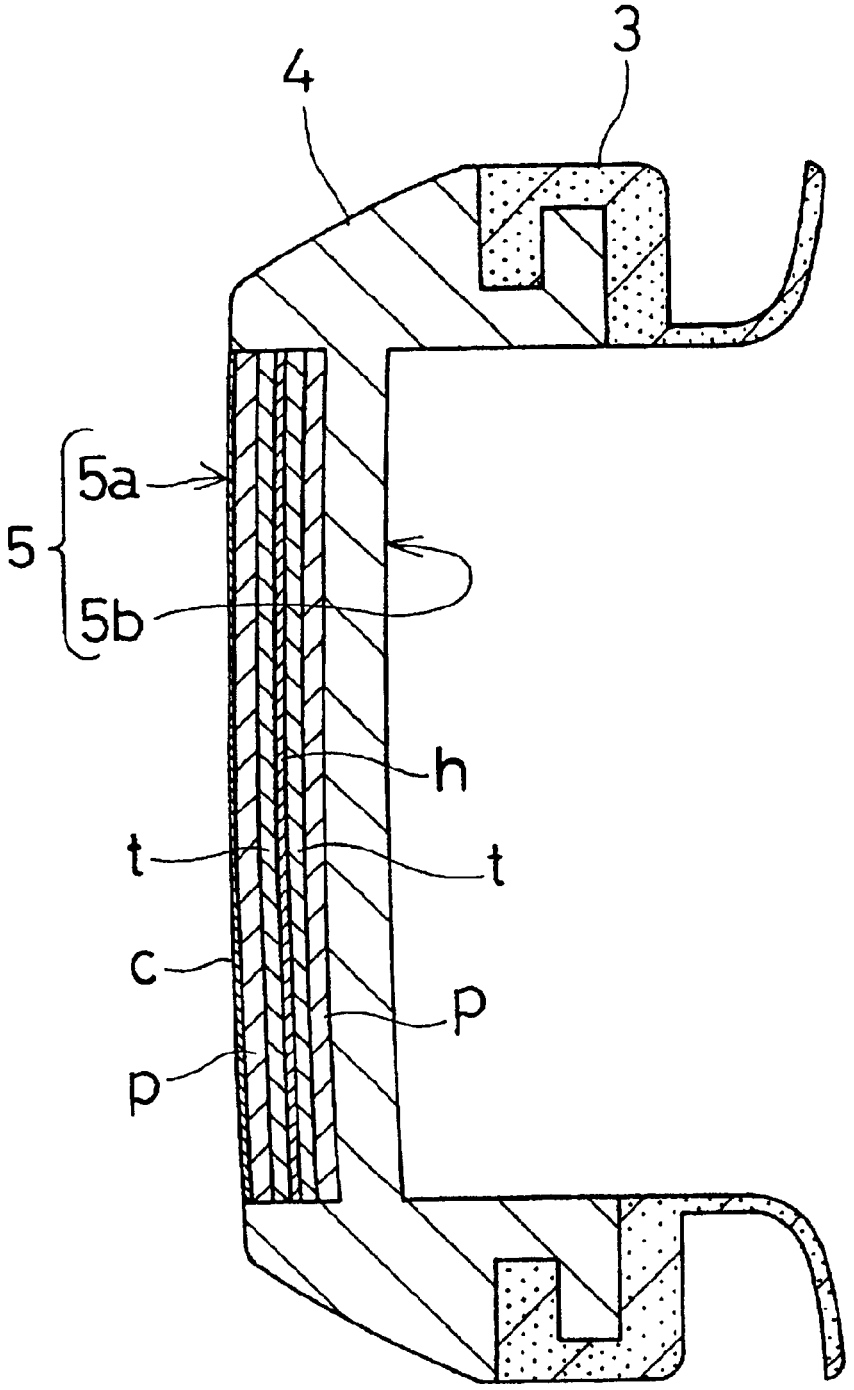
FIG. 5 is a sectional view showing main portions of another embodiment of swimming goggles of the present invention.

Next, by using the same injection mold and taking the same processes as in Embodiment 1, there results in a unified body with the goggle frame 4 and the goggle lens 5 as shown in FIG. 5.

The water goggles of this embodiment in which the goggle frames 4 and the goggle lenses 5 are unified, in an actual use in swimming, caused no water leakage between the goggle frames 4 and the goggle lenses 5, had no large decrease in the degree of polarization, and exhibited sufficient surface hardness. Furthermore, the degree of angle underwater was the same as that of conventional one, and no prism was introduced while they were in use. In addition, use for a certain time period causes no defective on the goggle lenses 5.

[Embodiment 5]

A laminate-processed six-layer polarized member, which is composed of an about 40 μm-thick polarized sheet h, about 80 μm-thick triacetyl cellulose sheets t applied on both sides of the polarized sheet h, about 100 μm-thick bisphenol A polycarbonate sheets p applied on the sheets t, and an about 10 μm-thick hard coat c applied on the outside surface, is subjected to a spherical heat bending process so as to be given a radius of curvature of 130 mm on the outside face, and then processed in accordance with the external dimensions of the goggle lens 5 to form the outer composing layer 5*a*. This outer composing layer 5*a* is put into an injection mold. The bisphenol A polycarbonate sheets p contain photo chromic dye of 0.1% by weight.

Figure 6:
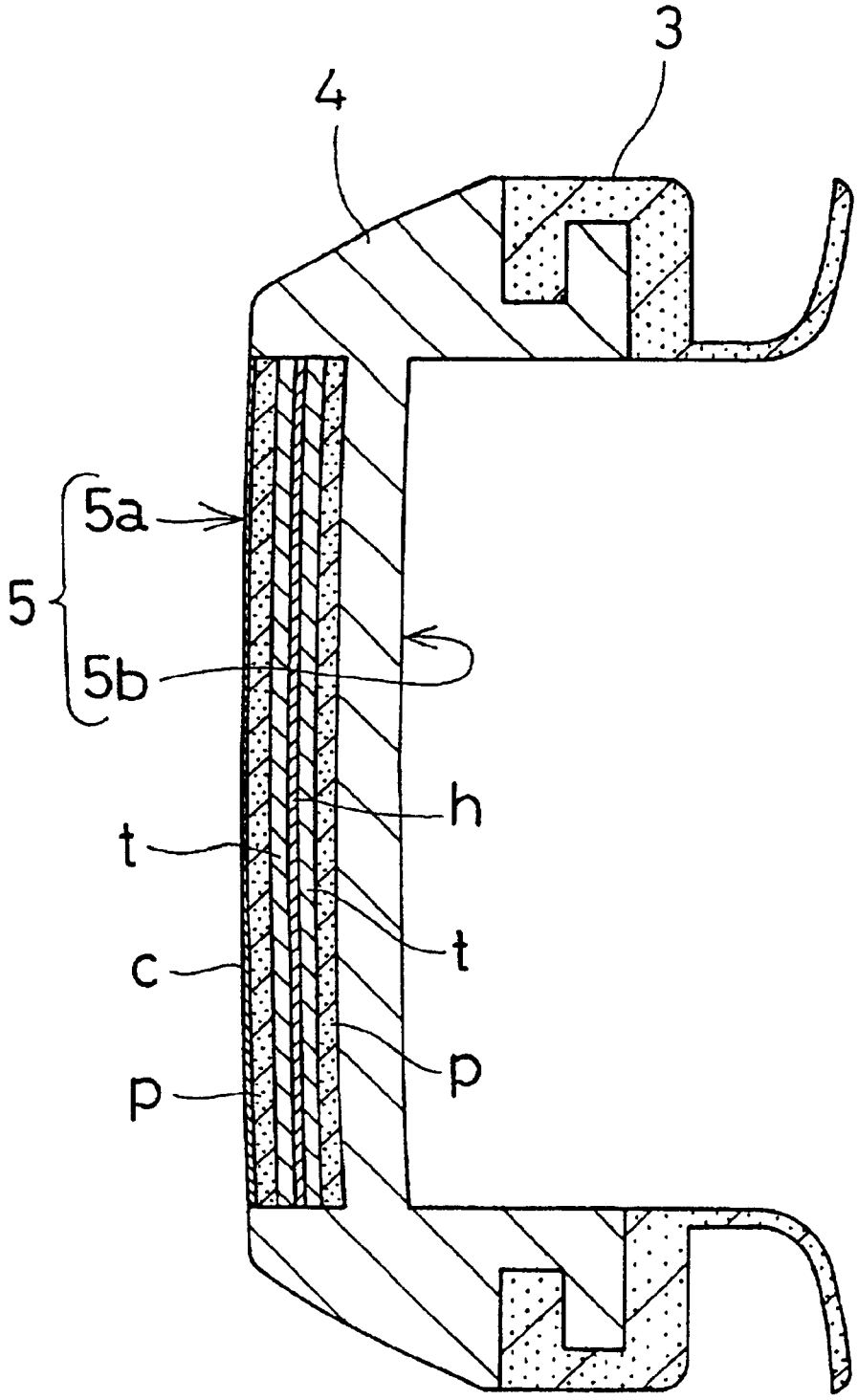
FIG. 6 is a sectional view showing main portions of another embodiment of swimming goggles of the present invention.

With the same injection mold and the same processes as stated in Embodiment 1, the goggle frame 4 is unified with the goggle lens 5 as shown in FIG. 6.

The swimming goggles of this embodiment in which the goggle frames 4 and the goggle lenses 5 are unified, in an actual use in swimming, caused no water penetration between the goggle frames 4 and the goggle lenses 5, had no large decrease in the degree of polarization, fully exhibited a photo chromic function, and provided sufficient surface hardness. Furthermore, the degree of angle under water did not change from that of conventional ones, and no prism was introduced while they were in use. In addition, use for a predetermined time of period caused no unwanted change.

[Embodiment 6]

A defogging process is applied to the inside face of a laminate-processed five-layered polarized member, which is composed of an about 40 μm-thick polarized sheet h, about 80 μm-thick triacetyl cellulose sheets t applied on both sides of the polarized sheet h, and about 100 μm-thick bisphenol A polycarbonate sheets p applied on the sheets t. Then the polarized member is subjected to a spherical heat bending process to be provided with a radius curvature of 525 mm on the inside face, and then processed in accordance with the external dimensions of the goggle lens 5 to form the inner composing layer 5*b*. Then, this inner composing layer 5*b* is put into an injection mold.

Next, with the same injunction mold and the same steps as in Embodiment 2, the unified body with the goggle frame 4 and the goggle lens 5, as shown in FIG. 7, is obtained.

In an actual use in swimming, the swimming goggles of this embodiment, in which the goggle frames 4 and the goggle lenses 5 are unified together, caused no water penetration between the goggle frames 4 and the goggle lenses 5, had no large decrease in the degree of polarization, exhibited uniform defogging performance on the inside faces of the lens, and extremely suppressed fogging of the inside of the lens. Furthermore, the degree of angle under water was the same as conventional ones, and no prism was introduced while they were in use. In addition, after a predetermined time period of use, the goggle lenses 5 had no unwanted change.

[Embodiment 7]

A defogging process is applied to the inside face of a laminate-processed five-layered polarized member, which is composed of an about 40 μm-thick polarized sheet h, about 80 μm-thick triacetyl cellulose sheets t applied on both sides of the polarized sheet h, and about 100 μm-thick bisphenol A polycarbonate sheets p applied on the sheets t. Then the polarized member is subjected to a spherical heat bending process to be provided on the inside face with a radius curvature of 525 mm, and then processed in accordance with the external dimensions of the goggle lens 5 to form the inner composing layer 5*b*. This inner composing layer 5*b* is put into an injection mold. The bisphenol A polycarbonate sheets p contain photo chromic dye 0.1% by weight.

Next, with the same injection mold and the same steps as in Embodiment 2, a unified body with the goggle frame 4 and the goggle lens 5 as shown in FIG. 8 is obtained.

The swimming goggles of this embodiment in which the goggle frames 4 and the goggle lenses 5 were unified, in an actual use in swimming, caused no water penetration between the goggle frames 4 and the goggle lenses 5, and no large decrease in the degree of polarization. The inside of the lens exhibited homogeneous defogging performance, and fogging thereon was extremely suppressed. And a sufficient photo chromic function was exhibited. Furthermore, the degree of angle under water was the same as conventional ones, and no prism was introduced while they were in use. In addition, the goggle lenses 5 had no unwanted change after they were used for a predetermined time period.

[Embodiment 8]

A laminate-processed three-layer polarized member, which is composed of an about 40 μm-thick polarized sheet h and about 200 μm-thick bisphenol A polycarbonate sheets p applied on both sides of the sheet h, is subjected to a spherical heat bending process so as to be given a radius of curvature of 130 mm on the outside face, and then processed in accordance with the external dimensions of the goggle lens 5 to form the outer composing layer 5*a*. Furthermore, an anti-fog member, which is made of a 0.8 mm-thick bisphenol A polycarbonate sheet p having the inside face defog-processed, is subjected to a spherical heat bending process so as to be provided, on the outside face, with a radius of curvature of 128 mm, and then processed in accordance with the external dimensions of the goggle lens 5 to form the inner composing layer 5*b*. And the resultant outer and inner composing layers 5*a* and 5*b* are put into an injection mold.

The injection mold of this embodiment is provided with two suction mechanisms; one allows the outside face of the outer composing layer 5*a* to be joined with a fixed side of the mold when the mold is closed, and the other allows the inside face of the inner composing layer 5*b* to be joined with a movable side of the mold. When molten resin is filled into the closed injection mold, the molten resin is deposited onto the inside face of the outer composing layer 5*a* and the outside face of the inner composing layer 5*b* so as to produce the goggle lens 5 with the middle composing layer 5*c*. The molten resin is further deposited onto the peripheral side faces of the outer and inner composing layers 5*a* and 5*b* so as to form the goggle frame 4. Thereby the goggle frame 4 and the goggle lens 5 are unified as shown in FIG. 9.

The swimming goggles of this embodiment in which the goggle frames 4 and the goggle lenses 5 were unified, in an actual use in swimming, caused no water penetration between the goggle frames 4 and the goggle lenses 5, had no large decrease in the degree of polarization and further exhibited sufficient surface toughness. Also the inside of the lens had homogeneous defogging performance and fogging thereon was extremely suppressed. Furthermore, the degree of angle under water was the same as conventional ones, and no prism was introduced while they were in use. In addition, the goggle lenses 5 had no unwanted change after the use for a predetermined time period.

Being constructed as above, the swimming goggles of the present invention are free from water penetration between the goggle frames and the goggle lenses, and allow an extremely high productivity and a low incidence of defective products.

What is claimed is:

1. Swimming goggles having goggle lenses and associated goggle frames, each of the goggle lenses comprising a first composing lens layer and a second composing lens layer, said first composing lens layer being unified with an associated goggle frame, wherein the first and second composing lens layers are welded together on their adjacent layer faces and the goggle frame is welded together to a peripheral side face of the second composing lens layer so that the goggle lens and the associated goggle frame are unified together.

2. Swimming goggles according to claim 1, wherein the first composing lens layer is an inner composing layer and the second composing lens layer is an outer composing layer, and the inner composing layer is welded together to an inside face of the outer composing layer.

3. Swimming goggles according to claim 1, wherein the first composing layer is an outer composing layer and the second composing layer is an inner composing layer, and the outer composing layer is welded together to an outside face of the inner composing layer.

4. Swimming goggles according to claim 1, wherein the first composing layer is a middle composing layer and the second composing layer is made up with an inner composing layer part and an outer composing layer part, and the outer composing layer part is welded together to an outside face of the middle composing layer and the inner composing layer part is welded together to an inside face of the middle composing layer.

5. Swimming goggles according to claim 1, wherein a unification of the goggle lens and the associated frame is produced in a way that the second composing lens layer is put in an injection mold and then molten resin is filled into the injection mold to be deposited onto the second composing lens layer to produce the goggle lens having the first composing lens layer, and molten resin is further deposited onto a peripheral side face of the second composing lens layer to form the goggle frame.

6. Swimming goggles according to claim 5, wherein the first composing lens layer is an inner composing layer and the second composing lens layer is an outer composing layer, and the molten resin is deposited onto an inside face of the outer composing layer to produce the goggle lens with the inner composing layer.

7. Swimming goggles according to claim 5, wherein the first composing layer is an outer composing layer and the second composing layer is an inner composing layer, and the molten resin is deposited onto an outside face of the inner composing layer to produce the goggle lens wit the outer composing layer.

8. Swimming goggles according to claim 5, wherein the first composing layer is a middle composing layer and the second composing layer is made up with an inner composing layer part and an outer composing layer part, and the molten resin is deposited onto an inside face of the outer composing layer part and an outside face of the inner composing layer part to produce the goggle lens with the middle composing layer.

9. Swimming goggles according to claim 2, wherein the outer composing layer and the inner composing layer respectively have predetermined radiuses of curvature.

10. Swimming Goggles according to claim 2, wherein function dye is contained in at least one of the outer composing layer and the inner composing layer.

11. Swimming Goggles according to claim 3, wherein function dye is contained in at least one of the outer composing layer and the inner composing layer.

12. Swimming Goggles according to claim 6, wherein function dye is contained in at least one of the outer composing layer and the inner composing layer.

13. Swimming goggles according to claim 7, wherein function dye is contained in at least one of the outer composing layer and the inner composing layer.

14. Swimming goggles according to claim 2, wherein the frames and the goggle lenses are made of polycarbonate resin.

15. Swimming goggles according to claim 3, wherein the goggle frames and the goggle lenses are made of polycarbonate resin.

16. Swimming goggles according to claim 4, wherein the goggle frames and the goggle lenses are made of polycarbonate resin.

17. Swimming goggles according to claim 6, wherein the goggles frames and the goggle lenses are made of polycarbonate resin.

18. Swimming goggles according to claim 7, wherein the goggle frames and the goggle lenses are made of polycarbonate resin.

19. Swimming goggles according to claim 8, wherein the goggle frames and the goggle lenses are made of polycarbonate resin.

20. Swimming goggles according to claim 2, wherein functional dye is contained at least one of the outer composing layer, the inner composing layer and the middle composing layer.

21. Swimming goggles according to claim 3, wherein the outer composing layer and the inner composing layer respectively have radiuses of curvature calculated in advance.

22. Swimming goggles according to claim 4, wherein the outer composing layer and the inner composing layer respectively have radiuses of curvature calculated in advance.

23. Swimming goggles according to claim 6, wherein the outer composing layer and the inner composing layer respectively have radiuses of curvature calculated in advance.

24. Swimming goggles according to claim 7, wherein the outer composing layer and the inner composing layer respectively have radiuses of curvature calculated in advance.

25. Swimming goggles according to claim 8, wherein the outer composing layer and the inner composing layer respectively have radiuses of curvature calculated in advance.

26. Swimming goggles according to claim 2, wherein a functional film or sheet is joined with at least one of the outer composing layer and the inner composing layer.

27. Swimming goggles according to claim 3, wherein a functional film or sheet is joined with at least one of the outer composing layer and the inner composing layer.

28. Swimming goggles according to claim 4, wherein a functional film or sheet is joined with at least one of the outer composing layer and the inner composing layer.

29. Swimming goggles according to claim 6, wherein a functional film or sheet is joined with at least one of the outer composing layer and the inner composing layer.

30. Swimming goggles according to claim 7, wherein a functional film or sheet is joined with at least one of the outer composing layer and the inner composing layer.

31. Swimming goggles according to claim 8, wherein a functional film or sheet is joined with at least one of the outer composing layer and the inner composing layer.

32. Swimming goggles according to claim 2, wherein functional dye is contained at least one of the outer composing layer, the inner composing layer and the middle composing layer.

33. Swimming goggles according to claim 3, wherein functional dye is contained at least one of the outer composing layer, the inner composing layer and the middle composing layer.

34. Swimming goggles according to claim 4, wherein functional dye is contained at least one of the outer composing layer, the inner composing layer and the middle composing layer.

35. Swimming goggles according to claim 6, wherein functional dye is contained at least one of the outer composing layer, the inner composing layer and the middle composing layer.

36. Swimming goggles according to claim 7, wherein functional dye is contained at least one of the outer composing layer, the inner composing layer and the middle composing layer.

37. Swimming goggles according to claim 8, wherein functional dye is contained at least one of the outer composing layer, the inner composing layer and the middle composing layer.

* * * * *